US006938285B2

(12) United States Patent
Fernie et al.

(10) Patent No.: US 6,938,285 B2
(45) Date of Patent: Sep. 6, 2005

(54) PATIENT TRANSFER DEVICE

(75) Inventors: Geoffrey Roy Fernie, Etobicoke (CA); Gerald T. Griggs, Scarborough (CA)

(73) Assignee: Sunnybrook and Women's College Health Sciences Centre, Toronto (CA)

( * ) Notice: Subject to any disclaimer, the term of this patent is extended or adjusted under 35 U.S.C. 154(b) by 0 days.

(21) Appl. No.: 09/986,050

(22) Filed: Oct. 22, 2001

(65) Prior Publication Data

US 2004/0148699 A1 Aug. 5, 2004

Related U.S. Application Data

(63) Continuation of application No. 09/420,648, filed on Oct. 19, 1999, now abandoned, which is a continuation of application No. 08/964,999, filed on Nov. 5, 1997, now abandoned.

(51) Int. Cl.[7] ..... A61G 7/14; A61G 7/10

(52) U.S. Cl. ..... 5/83.1; 5/86.1; 5/89.1; 5/81.1 R

(58) Field of Search ..... 5/81.1 R–89.1

(56) References Cited

U.S. PATENT DOCUMENTS

| | | | |
|---|---|---|---|
| 841,702 | A | 1/1907 | Martin |
| 1,876,832 | A | 9/1932 | Bancroft |
| 2,272,778 | A | 2/1942 | Reuter |
| 3,234,568 | A | 2/1966 | Fischer |
| 3,351,959 | A | 11/1967 | Turpin |
| 3,999,228 | A | 12/1976 | Thomas |
| 4,627,119 | A | 12/1986 | Hachey et al. |
| 4,805,248 | A | 2/1989 | Lunau |
| 5,333,335 | A | 8/1994 | Gastle et al. |
| 5,499,408 | A | 3/1996 | Nix |
| 5,692,253 | A | 12/1997 | Keijser et al. |

FOREIGN PATENT DOCUMENTS

| | | |
|---|---|---|
| DE | 111449 | 7/1900 |
| GB | 2291857 | 2/1996 |
| GB | 2295602 | 5/1996 |
| WO | WO 9628125 | 9/1996 |
| WO | WO 9633687 | 10/1996 |
| WO | WO 9710792 | 3/1997 |
| WO | WO 0027333 | 5/2000 |

OTHER PUBLICATIONS

Techlem Medical System Inc. Product Literature—14 pages.

T.H.E. Medical. Product Literature Ultralift+Steady Aid—4 pages.

Kvaerner Thune. Product Literature—4 pages.

(Continued)

*Primary Examiner*—Alexander Grosz
(74) *Attorney, Agent, or Firm*—Thomas A. O'Rourke; Bodner & O'Rourke

(57) ABSTRACT

Disclosed herein is a patient transfer device comprising lifting arrangement positionable adjacent a patient and movable between a first position and a second position, and support arrangement for supporting the patient. The support arrangement is attachable to the lifting arrangement along a number of anchor locations thereon, the anchor locations including a pair of central anchor locations, a first pair of outer anchor locations on one side of the pair of central anchor locations and a second pair of outer anchor locations on an opposite side of the central pair of anchor locations; the support arrangement including a pair of central contact locations near a central location on the body of the patient, a first pair of outer contact locations on one side of the pair of central contact locations and a second pair of outer contact locations on an opposite side of the central pair of contact locations. The support arrangement is operable with the lifting arrangement for joining each of the anchor locations to a corresponding one of the contact locations, so as to transfer the patient between an inclined position and an upright orientation when the lifting arrangement moves between the first and second positions.

31 Claims, 15 Drawing Sheets

OTHER PUBLICATIONS

WY EAST Medical. Product Literature—5 pages.
Toronto Star Newspaper Article. Dec. 7, 1996—Section H.—2 pages.
Team Rehab vol. 5, #5, May 1994 Report 1—1 page.
American Journal of Occupation Therapy, vol. 50 # 2, Feb 1996 What's New Article. Report 3—6 pages.
AAOHN—Evaluation of a Unique Mechanical Client Lift—May 1993 vol. 41. #5 Report 3—6 pages.
Nursing Standard—U.K. vol. 11, #6, Oct. 30, 1996 U.K. Evaluation of Mechanical aids used within the NHS Report 4—6 pages.
ECRI—Mar. 1990, vol. 19 #3, Report 5—32 pages.
Request—Product Comparison and Evaluation, Patient Lifts. Jan., 1990 Report 6—101 pages.
Love Lift System—Healthcare Facility Model Winter 1993, News Product Literature—5 pages.
Mecanaids—Ambulift Model D—2 pages.
Nov. 4$^{th}$, 1997 Derwent Search—5 pages.
Oct. 30$^{th}$, 1997 Derwent Search—5 pages.
Oct. 29$^{th}$, 1997 Derwent Search—5 pages.
Sturdylift Website Information—4 pages.
IBM search report—6 pages.
North Coast—Product Literature—4 pages.
Porto—Lift Product Literature—4 pages.
Samhall Rehab Product Literature—3 pages.
Smith & Nephew Rehabilitation Product Literature—5 pages.
Scan Medical—Product Literature—23 pages.
Arjo–Century Inc.—Product Literature—40 pages.
Apex Dynamics Liftran—320—6 pages.
Barrier Free Lifts—Product Literature—18 pages.
Armada Technologies Inc. Product Literature—17 pages.
Chiltern—Product Literature—2 pages.
Borndal Medical Equipment Inc.—The Travelmaster Lift Product Literature 1 page.
Arylift—Product Literature—7 pages.
CM—Columbus McKinnon Corp. Product Literature—6 pages.
DMA—Bays Medical Aids Ltd. Product Literature—6 pages.
Everest & Jennings—Product Literature—2 pages.
Doncaster Home Health Care—Information—2 pages.
Guildmann—Product Literature—9 pages.
Guardian Sunrise Medical Trans—Aid—Product Literature—2 pages.
T.F. Herceg Inc.—Handi—move Product Literature—7 pages.
Rand–Scot Inc. EasyPivot Lift—Product Literature—8 pages.
MEDI—MAN Rehabilitation Products Inc. Product Literature—11 pages.
Healthcare Dynamics. Product literature—2 pages.
Invacare Corp. Product Literature—2 pages.
Lift Aid Inc. Product Literature Meditrade 1996—2 pages.

PATIENT TRANSFER DEVICE

This application is a Continuation of application Ser. No. 09/420,648 filed Oct. 19, 1999 now abandoned, which is a Continuation of application Ser. No. 08/964,999 filed Nov. 5, 1997 now abandoned. This application also claims priority benefit from PCT application Ser. No. PCT/CA00/001137, filed Oct. 6, 2000.

BACKGROUND OF THE INVENTION

1. Field of the Invention

The present invention relates to patient transfer systems.

2. Description of the Related Art

Workers in the health care profession have seen an increase in the work load as governments cut back funding to, and thus lay-off of staff in, hospitals, nursing homes and the like. Reductions in available staff present additional challenges when physically incapacitated patients need transfer from one location to another. Traditionally this has been carried out by one or more staff who manually support the patient to a degree depending on the patient's ability. In some cases, particularly with an infirm patient, large and bulky stretchers are used when the stretcher can be positioned alongside the patent. In other cases, lifting devices are used to lift the patient in a sling and, with the help of staff be transferred by the lifting device as it rolls along the floor with the patient suspended off the floor.

These transfer methods are tedious and present significant risk of injury to the staff as a result of bearing the patient's weight and perhaps tripping or slipping during the transfer. These transfer methods are also unsatisfactory for the patient because of the potential of injury as well as an added loss of dignity and the fear of being dropped. There remains a need to improve patient transfer.

It is an object of the present invention to provide a novel patient transfer device.

SUMMARY OF THE INVENTION

Briefly stated, the invention involves a patient transfer device comprising lifting means positionable adjacent the patient and movable between a first position and a second position, and support means for supporting the patient, the support means being attachable to the lifting means along a number of anchor locations thereon, the anchor locations including a pair of central anchor locations, a first pair of outer anchor locations on one side of the pair of central anchor locations and a second pair of outer anchor locations on an opposite side of the central pair of anchor locations; the support means including a pair of central contact locations near a central location on the body of the patient, a first pair of outer contact locations on one side of the pair of central contact locations and a second pair of outer contact locations on an opposite side of the central pair of contact locations; the support means being operable with the lifting means for joining each of the anchor locations to a corresponding one of the contact locations, so as to transfer the patient between an inclined position and an upright orientation when the lifting means moves between the first and second positions.

In another aspect of the present invention, there is provided a device for transferring a patient, the patient having a upper region, a mid region and a lower region, the device comprising a lifting means and a sling means, the sling means being dimensioned to extend beneath and along the upper, mid and lower regions, and transfer means arranged to join the lifting means with the sling means at a number of locations along the sling means, the locations being selected to cause the upper and lower regions to be rotated relative to the mid portion as the lifting means is moved between a first position and a second position.

In one embodiment, the lifting means includes at least one beam member, preferably two, which are aligned with the patient in one of the positions, wherein the transfer means includes a plurality of tension members mounted along the beams, including a central tension member and an outer tension member on each side thereof, wherein the central tension member engages the sling means adjacent the mid region and the outer tension members engage the sling means adjacent the lower and upper regions respectively. More preferably, the lower region includes a patient's legs and each beam supports a pair of outer tension members on one side of the central tension members, each pair of outer tension members being arranged to engage the sling means on opposite sides of a corresponding one of the legs. A cross member joins the beams at one end, the cross member being arranged to function as a hand grip for the patient.

In other aspect of the present invention, there is provided a patient transfer device, comprising a manipulator arrangement rotatable about a first axis between a plurality of operable positions, support means supporting a patient beneath the manipulator arrangement, the manipulator arrangement including a pair of central anchor locations to support the patient on opposite sides and near the buttocks thereof and a pair of outer anchor locations on either side of the central anchor locations to support the patient on opposite sides of and at spaced locations from the buttocks, the central and outer anchor locations being arranged to move the patient from an inclined orientation to an upright orientation when the manipulator moves between at least two of the operable positions.

In one embodiment, the manipulator arrangement includes a pair of beam members arranged to extend along the patient in one operative position and rotatable about the first axis, each of the beam members having central regions providing the central anchor locations and opposed end regions providing a corresponding one of the outer anchor locations. The beams form a plane and the rotation axis extends through the plane. A cross member extends between the beams at corresponding adjacent end regions thereof and is rigidly coupled therewith. The beams in the second operative position extend in front of the patient and the cross member is arranged to extend sufficiently close to the patient for gripping the cross member for support. Desirably, the cross member is provided with a pair of handle formations thereon. Preferably, the manipulator arrangement may include a pair of frame members, each of which is jointed to a corresponding beam member, the beam members being movable relative thereto.

In still another aspect of the present invention, there is provided a device for supporting a patient, the patient having an upper region, a mid region and a lower region, the device operable for connection to a manipulator arrangement to be positioned above the patient, the harness being dimensioned to extend beneath and along the upper, mid and lower regions and providing a central contact location adjacent each of the mid regions, and a pair of outer contact locations adjacent the upper and lower regions, tension members joining each of the contact locations, each of the tension members being arranged to transfer the patient from an inclined orientation to an upright orientation.

In one embodiment, the harness includes a first end to be positioned adjacent the legs of the patient and a second end to be positioned near the head of the patient, each of the contact locations to be positioned adjacent an outer side of a corresponding leg of the patient. The harness includes a sheet member having a pair of longitudinal peripheral regions, to lie adjacent each side of the patient, each of the central contact locations and each of outer contact locations being defined on a corresponding one of the peripheral regions.

Preferably, the harness provides a supplemental outer contact location adjacent an inner side of a corresponding leg of the patient. The sheet has a pair of inner peripheral edge regions in the first end defining a centrally located longitudinally oriented gap, each of the supplemental outer contact locations being positioned adjacent the gap. A flap portion is provided on each on inner peripheral edge region and each of the third outer contact locations are formed on a corresponding flap portion.

In still another aspect of the present invention, there is provided a device for transferring a patient, comprising a pair of beam members extending along the patient in one operative position, and rotatable about a beam rotation axis, the beam members having a opposed end regions, support means for supporting the patient, the support means including first and second attachment locations, first and second joining means for joining each of the first and second attachment locations with a corresponding end region, the locations being selected to transfer the patient from an inclined orientation to an upright orientation when the beams rotate between first and second operative positions relative to the beam rotation axis.

In one embodiment, the beams form a plane, the rotation axis extends through the plane and a cross member extends between the beams at corresponding adjacent end regions thereof and is rigidly coupled therewith. Preferably, the beams in the second operative position extend in front of the patient. The cross member is conveniently provided with a pair of handle formations thereon and is arranged to extend sufficiently close to the patient for gripping the cross member for support and cross member.

In yet another aspect of the present invention, there is provided a method of transferring a patient from an inclined orientation to an upright orientation, comprising the steps of:

providing a support beneath the patient, providing on the support a pair of central contact locations near the buttocks of the patient and on opposite sides thereof;

providing on the support a pair of outer contact locations on opposite sides of the pair of central contact locations and spaced therefrom, wherein the support is capable of bearing the weight of the patient in the inclined orientation at the central and outer contact locations; and lifting the support at the central and outer contact locations in such a manner to raise the patient to the upright orientation.

BRIEF DESCRIPTION OF THE DRAWINGS

Several preferred embodiments of the present invention will now be described, by way of example only, with reference to the appended drawings in which.

DESCRIPTION OF THE PREFERRED EMBODIMENTS

Figure 4:
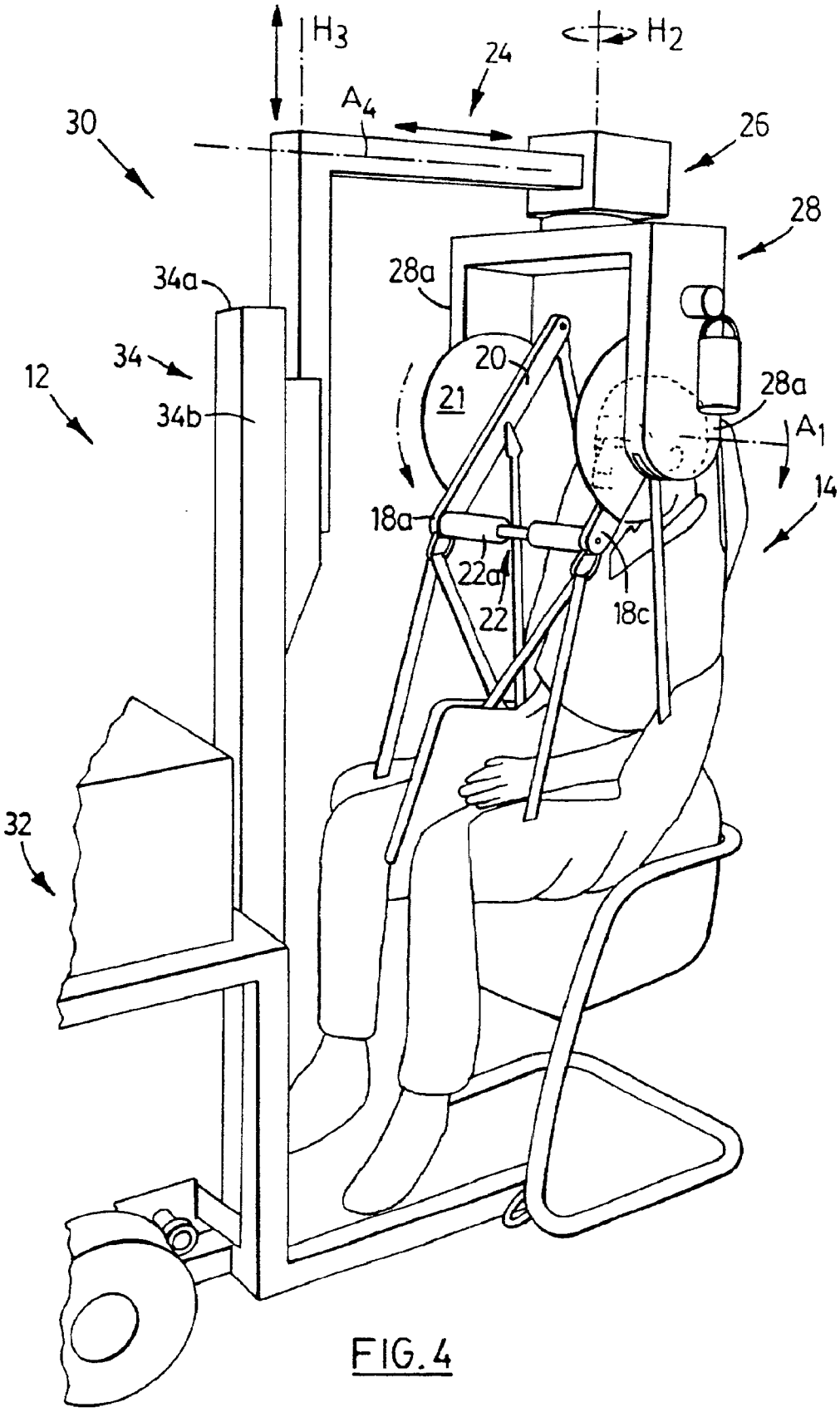
FIG. 4 is a fragmentary perspective view of the device of FIG. 1 in an operative position.
Figure 5:
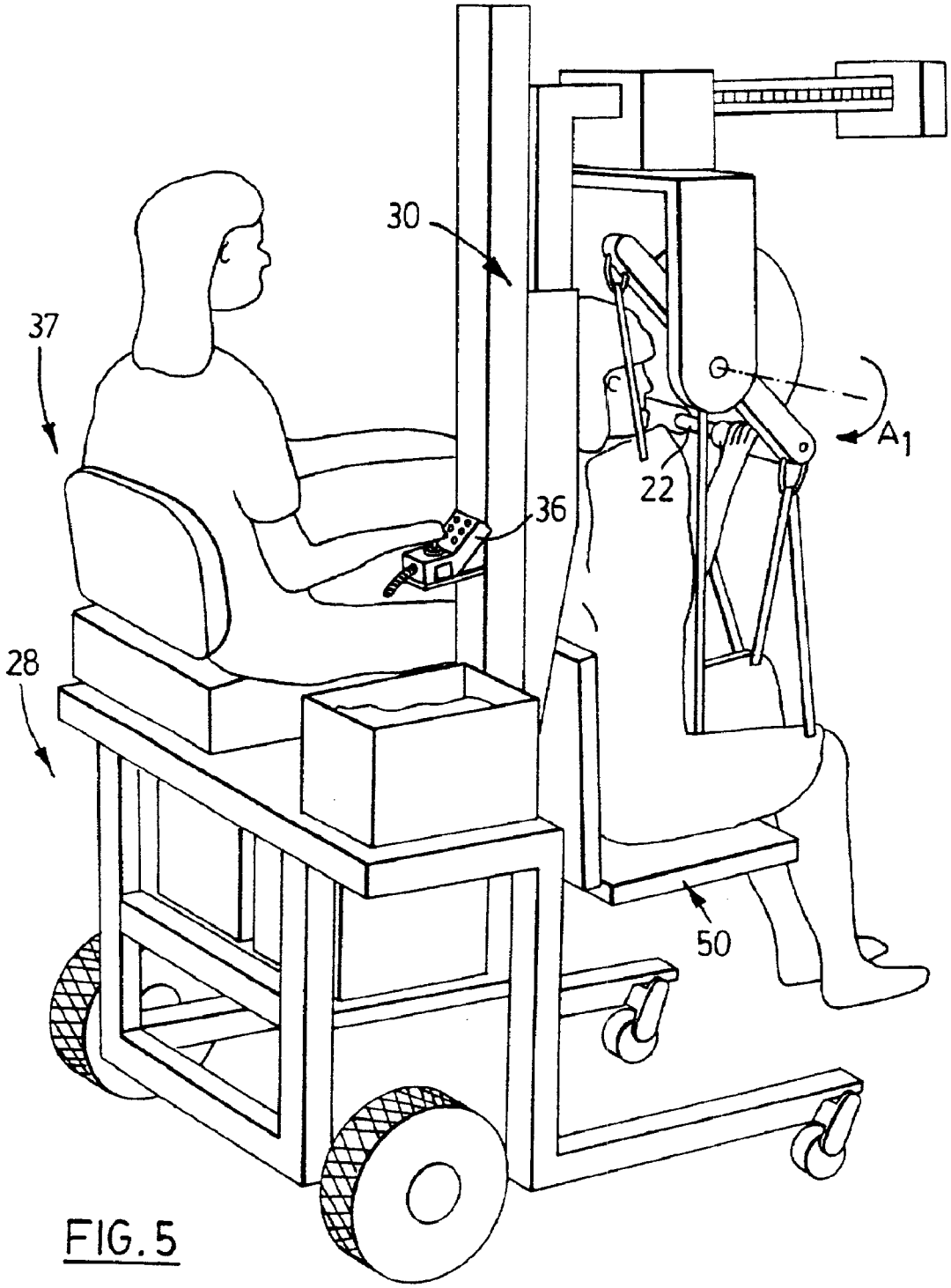
FIG. 5 is a perspective view of the device of FIG. 1 in another operative position.
Figure 6:
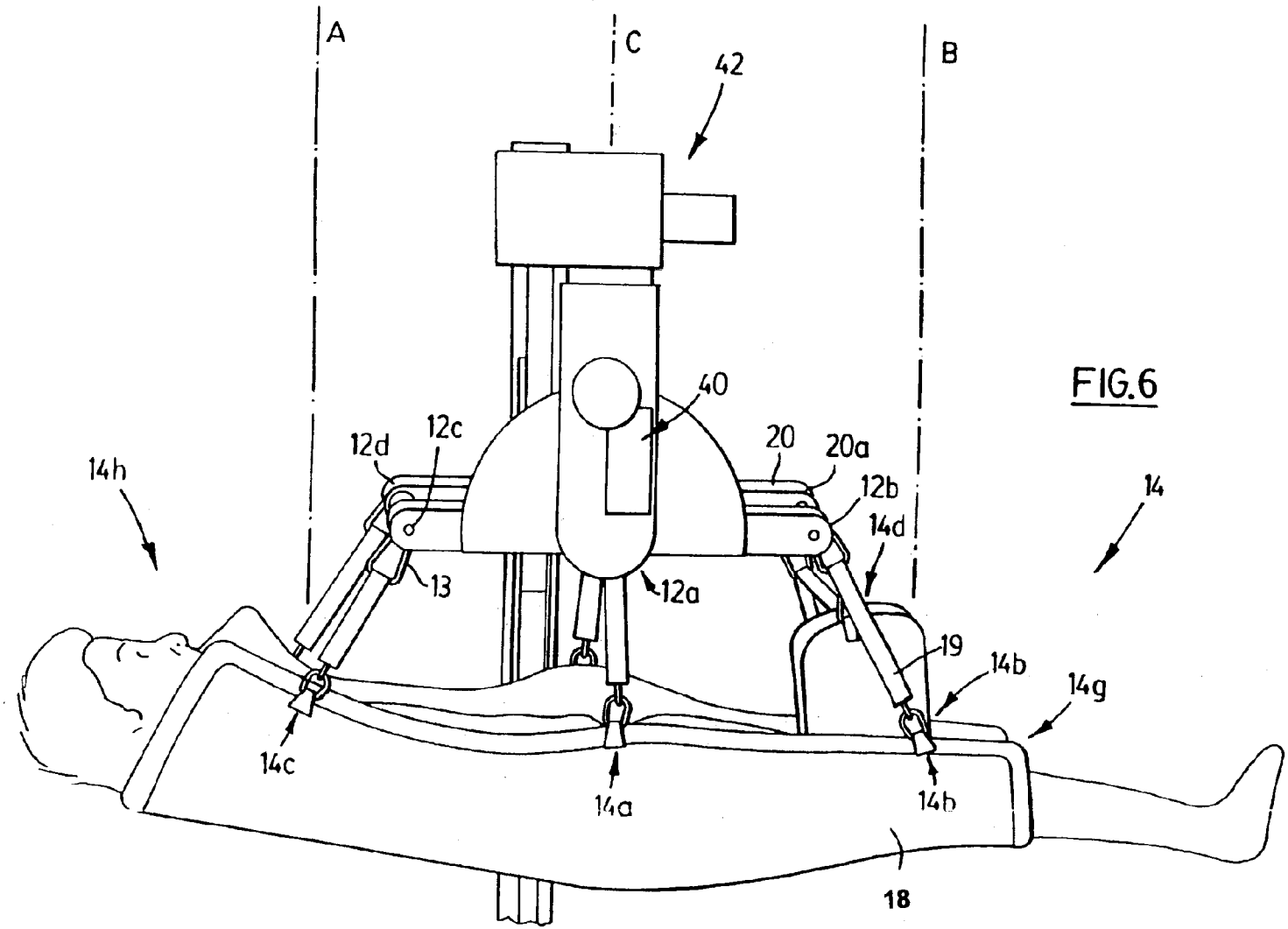
FIG. 6 is a fragmentary perspective view of the device of FIG. 1 in still another operative position.
Figure 6A:
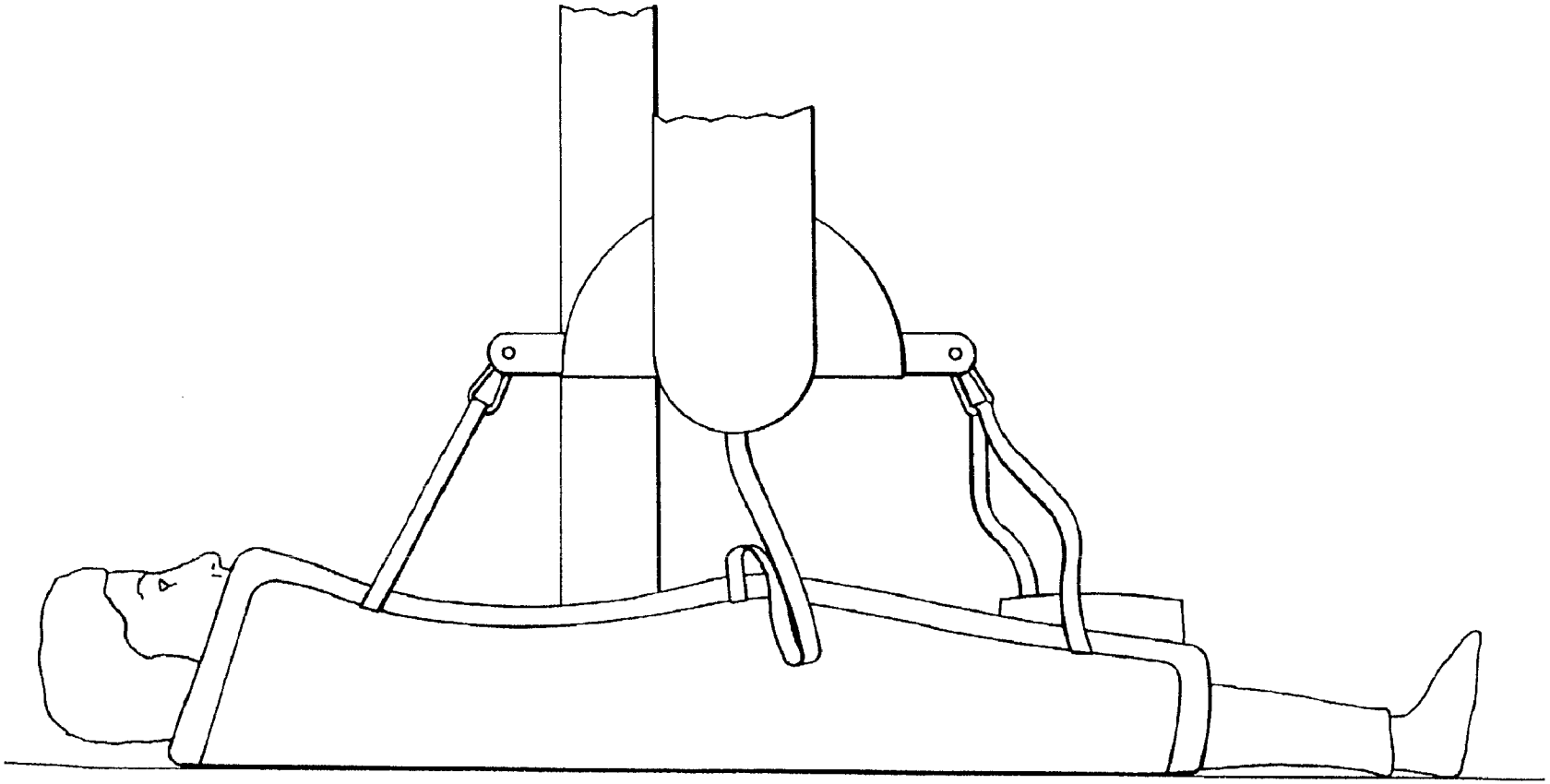
FIGS. 6A, 6B, 6C 6D are fragmentary perspective views of the device of FIG. 1 in still other operative positions.
Figure 6B:
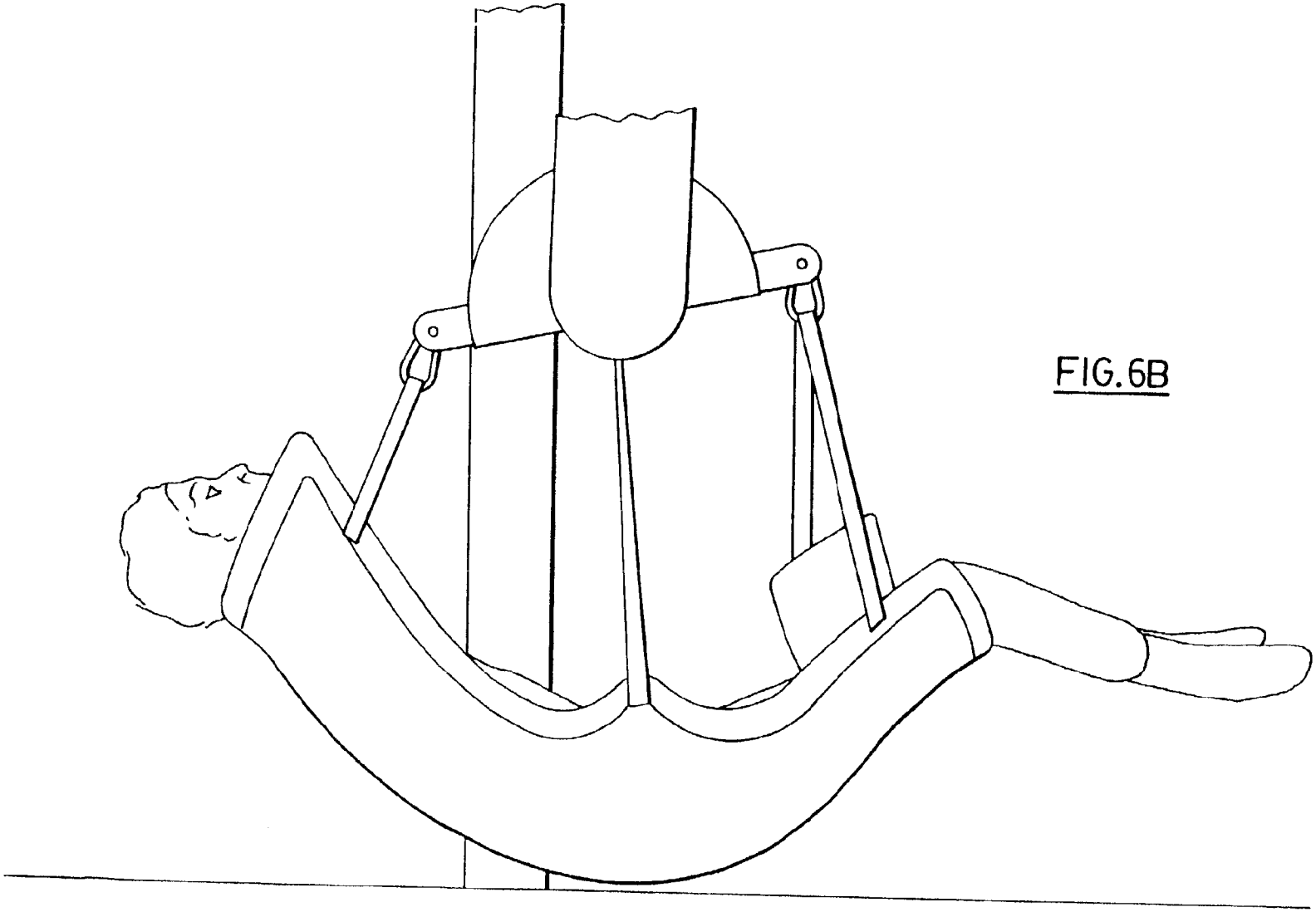

As will be described, there is provided a patient transfer device 10 having a lifting means 12 in the form of a manipulator arrangement, which is positionable adjacent the patient and movable between a first position, such as that shown in FIG. 6 and a second position as shown in FIG. 4. Support means generally shown at 14 in FIGS. 4 to 6 is provided in the form of a harness or sling and is attachable to the lifting means 12 along a number of anchor locations, including a pair of central anchor locations 12*a*, a first pair of outer anchor locations 12*b* and a second pair of outer anchor locations 12*c*. The harness includes a pair of central contact locations 14*a* near a central body location, such as the buttocks or pelvis, of the patient, a first pair of outer contact locations 14*b* and a second pair of outer contact locations 14*c*. Preferably, the anchor locations lie in a common plane rotatable relative to a first rotation axis A1 as shown in FIG. 4. In this particular case, the anchor locations are fixed in position relative to one another and the central contact locations are movable relative to one another as the patient moves between a inclined orientation as seen in FIG. 6 and an upright orientation as shown in FIG. 4.

Figure 7:
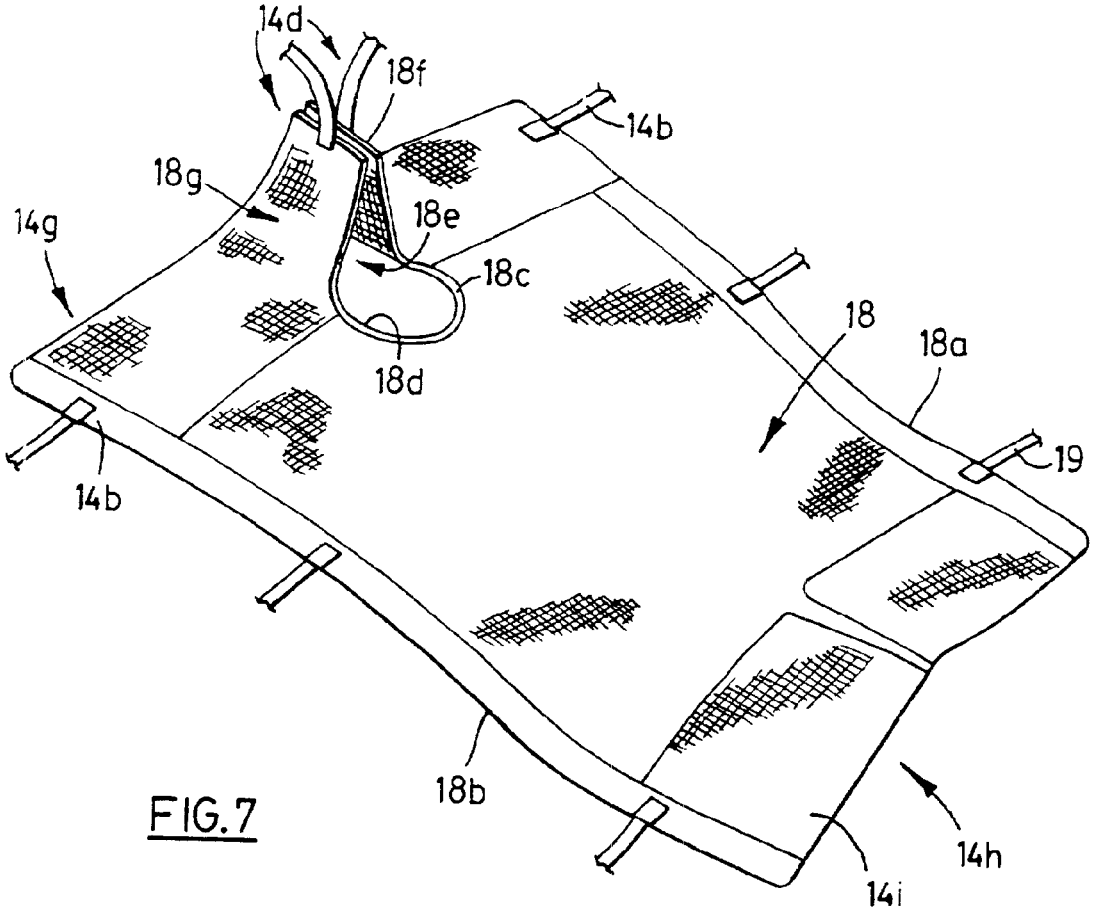
FIG. 7 is a fragmentary perspective view of a portion of the device of FIG. 1.
Figure 8:
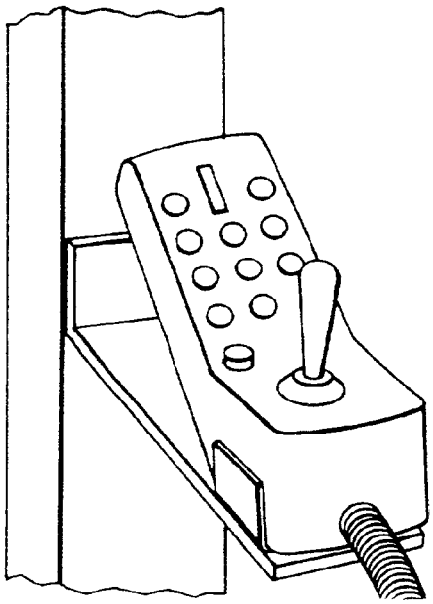
FIG. 8 is a fragmentary perspective view of another portion of the device of FIG. 1.

As will be described, the harness 14 provides a third pair of outer contact locations 14*d* in the region of the first pair of contact locations for reasons to be explained. As shown in FIG. 7, the harness, in this case, includes a sheet material 18, having a pair of longitudinal peripheral regions 18*a*, 18*b* to lie adjacent a corresponding side of the patient. Each of the central contact locations and each of first and second pairs of outer contact locations are, in this case, defined on a corresponding peripheral region. A plurality of length adjustable tension members 19, in this case in the form of straps, are fastened to the sheet 18 and provided with an appropriate coupling such as a hook or loop to join each of the contact locations with a corresponding anchor location, which in this case are provided in the form of rings 13.

The harness includes a first end 14*g* to be positioned adjacent the legs of the patient and a second end 14*h* to be positioned near the head of the patient and is provided with reinforced regions 14*i* in the second end 14*h* to provide additional support to the head and neck. Each of the first outer contact locations 14*b* are positioned adjacent an outer side of a corresponding leg of the patient, while each of the third outer contact locations 14*d* are positioned adjacent an inner side of a corresponding leg of the patient. To that end, the sheet has a pair of inner peripheral edge regions 18*c*, 18*d* in the first end defining a centrally located longitudinally oriented gap 18*e*. Each of the third outer contact locations 14*d* are located adjacent the gap. More particularly, the sheet has a pair of flap portions 18*f*, 18*g* and each of the third outer contact locations are, in effect, formed on a corresponding flap portion.

The harness is configured to support the patient in a number of locations and operates on the principle that these multiple locations can be controlled by the lifting means to transfer the patient from the inclined orientation to the upright orientation. Moreover, the patient can, with operator practice, be transferred from a bed in the inclined orientation, directly to a chair in the upright orientation essentially without need for further manual adjustments being made by the staff to the patient, such as by drawing the patient into the chair or the like.

Figure 6C:
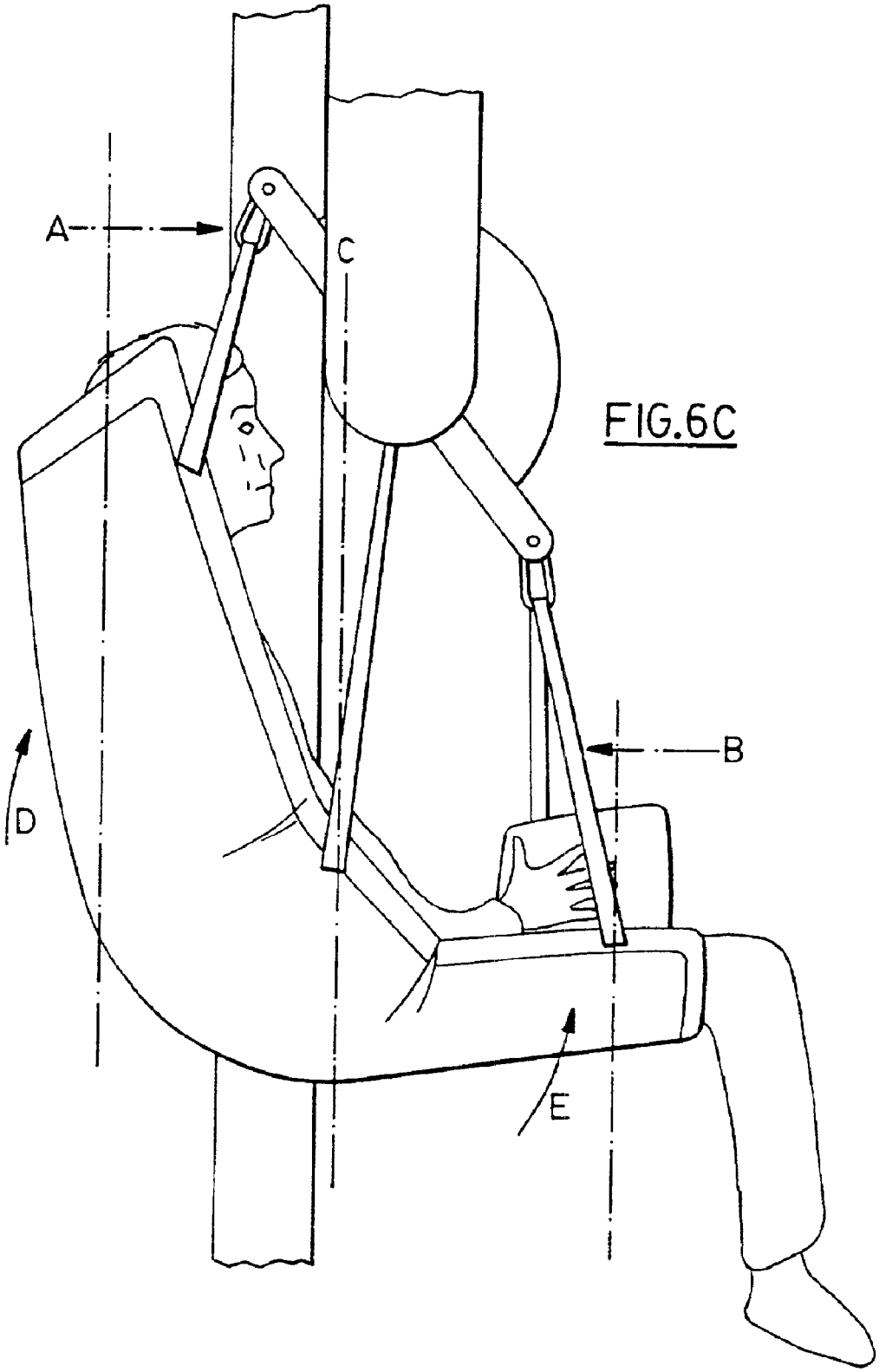

This is due to the fact that the straps at the shoulder in effect urge the patients back not only upward but also in the horizontal direction toward the buttocks, that is from 'A' toward 'C' in FIG. 6C. Similarly the straps at the knees bias them in the opposite horizontal direction toward the buttocks from 'B' to 'C'. The net effect, therefore is that the portion of the harness adjacent the back of the patient is rotated upwardly relative to the patient's hips and in the direction of arrow D. Therefore, the harness is not only capable of lifting and transferring the patient in the horizontal orientation but also is capable of bringing the patient to an upright orientation or sitting position simply through the transfer of the lifting means.

It should be pointed out that the harness in FIG. 6C is slightly shorter than that shown in FIG. 6 and is desirable in this instance because the shorter harness does allow the legs to bend comfortably at the knee in the upright orientation.

The harness also provides an improved degree of security to the patient because the harness has the ability to engage the patient in a number of locations which themselves are passed through coordinated movements. These locations generally include the shoulder region, the buttocks or pelvic region and the knee region.

In this particular case, the knee region is not provided with just two locations but rather with four. This allows the harness to support the patient by bearing the entire weight of the patient without having to draw the legs of the patient tightly toward one another, at the expense of patient comfort. Instead, each leg can be independently lifted by the harness.

The spacing of the multiple locations of the harness also increases the control of the patient's motion during both the transfer as aforementioned and during the travel with the patient on board, that is from one room to another. The patient, in this case, is less apt to swing uncontrollably as can be the case with conventional lifting devices. Furthermore, when the device 10 is turned at a corner, say when moving from a hallway into a hospital room, the patient's body should also change direction in a controlled manner with the device as the forces are applied to a number of spaced locations along the patient.

Referring to FIGS. 4 and 6, the lifting means 12 includes a pair of beam members 20 which themselves have a first end 20*a* and a second end 20*b*, with a cross member 22 joining the first ends as shown in FIGS. 4 and 5. The cross member also provides a convenient location for handle formations with reach of the patient in this upright position, giving the patient an enhanced feeling of security. The lifting means 12 has a track portion 24, and a carriage portion 26 movable relative to the track portion along axis A4. The carriage portion includes mounting means for mounting the beam members thereto, in the form of a yoke arrangement 28 extending between the carriage member and the beam members. The yoke arrangement is mounted for movement relative to the carriage about an yoke swivel axis H2, while the beam members are mounted for synchronized movement relative to the yoke arrangement about a beam rotation axis. In this particular case, the beam rotation axis is coextensive with the first rotation axis A1.

Figure 2:
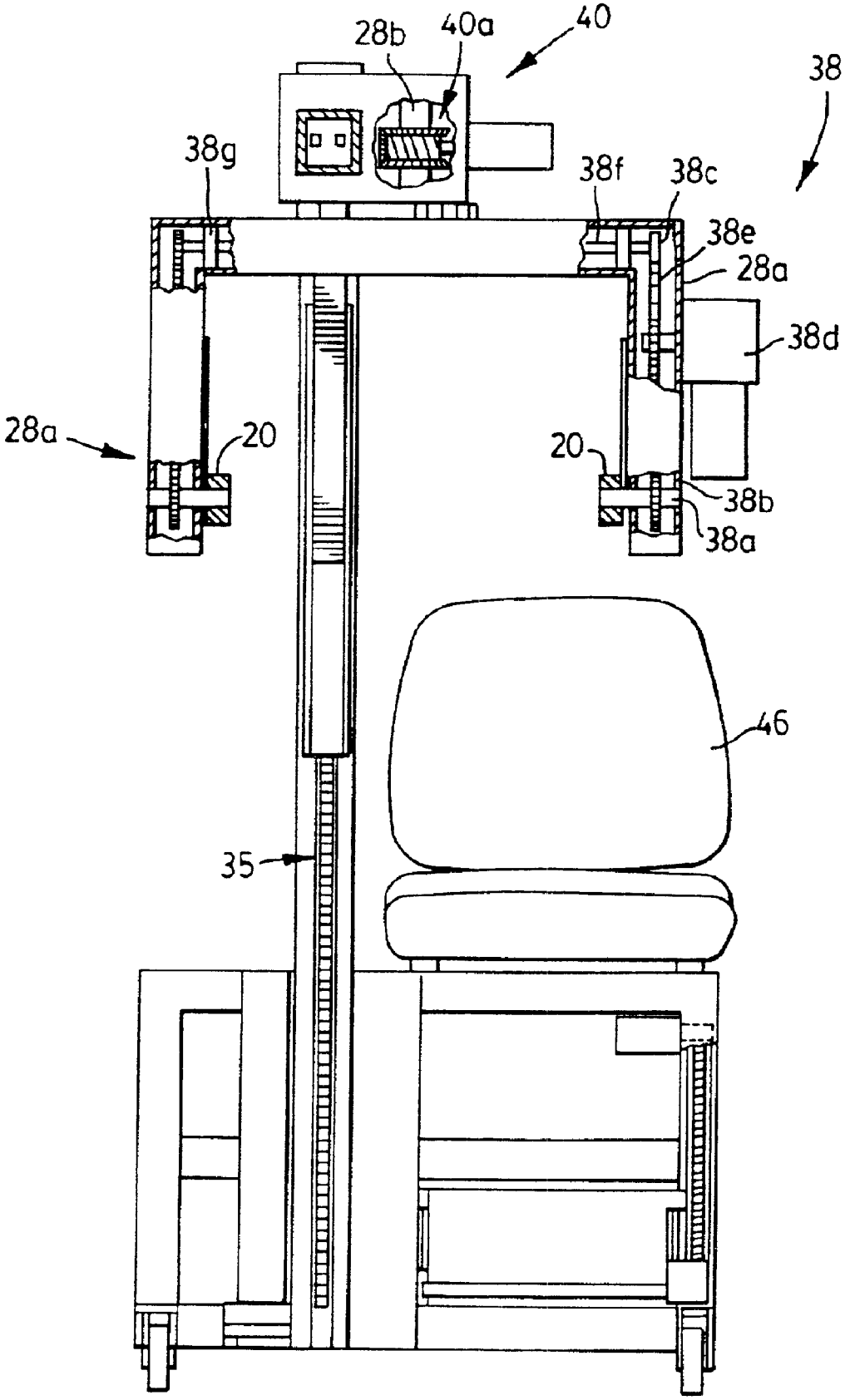
FIG. 2 is a partial fragmentary sectional front view of the device of FIG. 1.
Figure 2A:
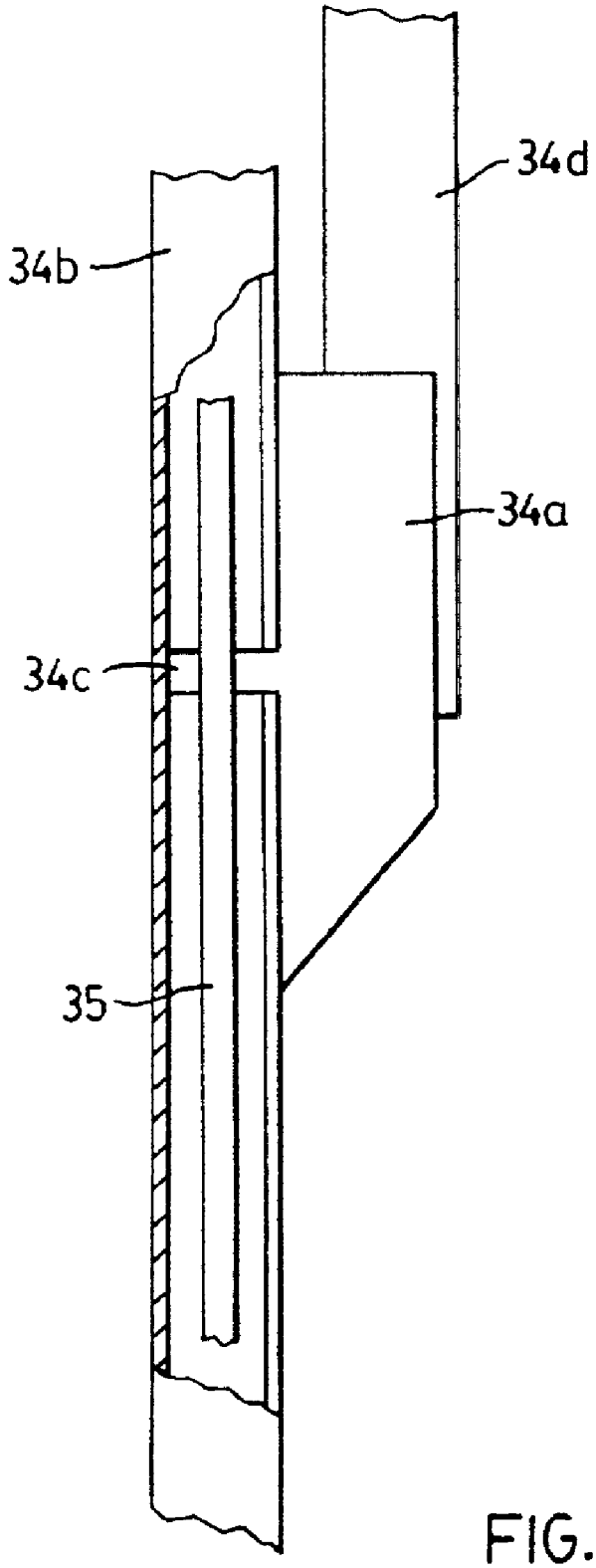
FIG. 2*a* is a sectional fragmentary view of a portion of the device of FIG. 1.
Figure 3:
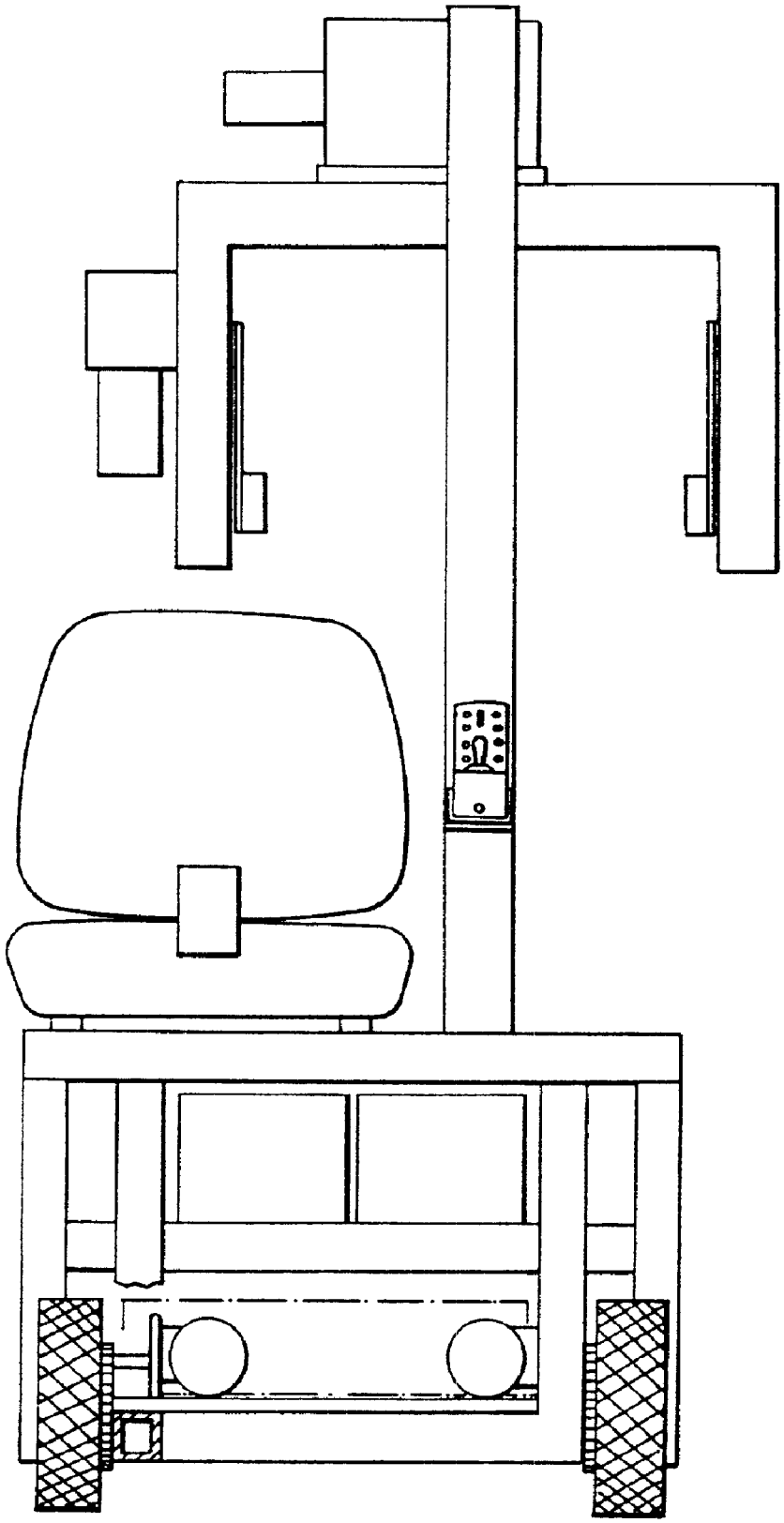
FIG. 3 is a rear view of the device of FIG. 1.

The lifting means also includes a lift portion 30 and the track portion is mounted for movement relative thereto along a lift axis H3. The lift portion includes a truck 32 having a height adjustable post 34 extending upwardly therefrom and means for lifting the post relative to the truck, such as a screw thread hoist mechanism 35 as shown in FIGS. 2 and 2*a*, wherein the post has a movable portion 34*a* which moves relative to a fixed portion 34*b*, wherein the movable portion 34*a* travels with a screw element 34*c*, itself entrained for travel along the screw shown at 35. The movable portion 34*a* is adjustably engaged with an upright portion 34*d* which itself is joined to the track portion 24. The truck is provided with a set of controls 36 and an operator location 37 on which a truck operator is situated to operate the truck. The controls operate, among other things, a beam motor mechanism 38 for displacing the beam members relative to the yoke arrangement, and a yoke motor mechanism 40 for displacing the yoke arrangement relative to the carriage portion as well as the screw thread hoist mechanism 35.

Looking at the beam motor mechanism 38 in more detail as shown in FIGS. 2 and 4, the yoke arrangement 28 has a pair of frame members in the form of legs 28*a* and the beam members 20 are pivoted to the legs by way of a pivot shaft 38*a* which is entrained with a lower sprocket 38*b* which in turn is entrained with an upper sprocket 38*c* and a sprocketed motor 38*d* by way of a chain 38*e*. The upper sprocket 38*c* is fixed to one end of a transfer shaft 38*f* held in bearings 38*g* in such a manner that the transfer shaft 38*f* transfers power between the left and right upper sprockets 38*c* as viewed in FIG. 2 so that the motor, on the right hand side, is able to control simultaneously the displacement of both the right hand and left hand beam members 20. For safety reasons, the beam members are provided with guards 21 which prevent the device operator or patient from getting hands jammed between the beam members and the yoke arrangement during movements therebetween and, in this case, are semicircular.

The yoke arrangement 28 is pivotally connected to the carriage 26 by way of a pivot shaft 28*b* which, by way of a worm gear 40*a*, is engaged with a yoke motor mechanism 40. The carriage, in turn, is slidably engaged with the track member 24 by away of a motor mechanism, not shown.

Figure 1:
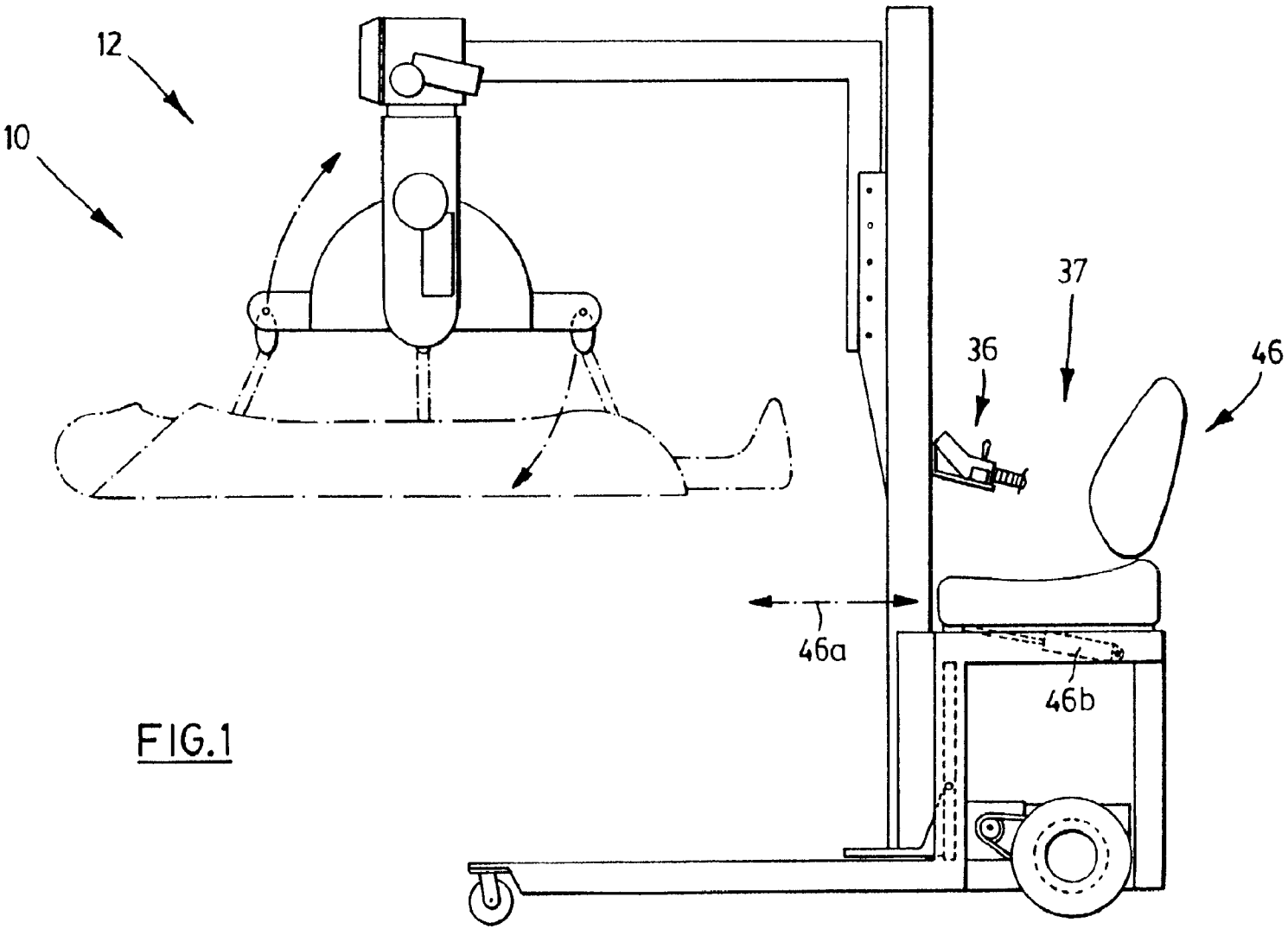
FIG. 1 is a side view of a patient transfer device.

The operator location includes a seat 46, which is movable between a first position remote from the patient shown in solid lines in FIG. 1 toward the patient as shown by arrow 46*a* by way of a linear actuator 46*b*; enabling direct contact between the operator and the patient, for reasons to be described.

To operate the device, the patient is first fitted with the harness. This could mean, for example, that the patient is inclined on a bed and is rolled to one side to insert the harness beneath her. In this case, the tension members may be adjusted depending on the height, size of patient and the type of transfer. Alternatively, the patient perhaps could be seated on a chair which already has the harness in the appropriate orientation to receive the patient, that is the first end of the harness nearer to the floor and the second end perhaps draped over the back of the chair. Alternatively, the harness may be inserted behind an already seated patient and can also be removed from behind the seated patient by having the patient move to one side and then another.

The operator is then seated at the operator location and directs the device toward a patient and the orientation of the beam members is arranged depending on the orientation of the patient. For example, if the patient is lying on a bed, the beam members may be moved to their first position as shown in FIG. 1 and the elevation of the beam members lowered to a safe distance above the patient, while allowing the straps of the harness to connected to their appropriate locations on the beam members. The operator then manipulates the controls as needed to transfer the patient to an intermediate position where the beams extend in front of the patient and the patient can, if desired, grip the cross member 22 for an added sense of security. This might include, for example, swivelling the yoke arrangement so that the patient moves from the position as shown in FIG. 4 to a reversed position as shown in FIG. 5.

Figure 6D:
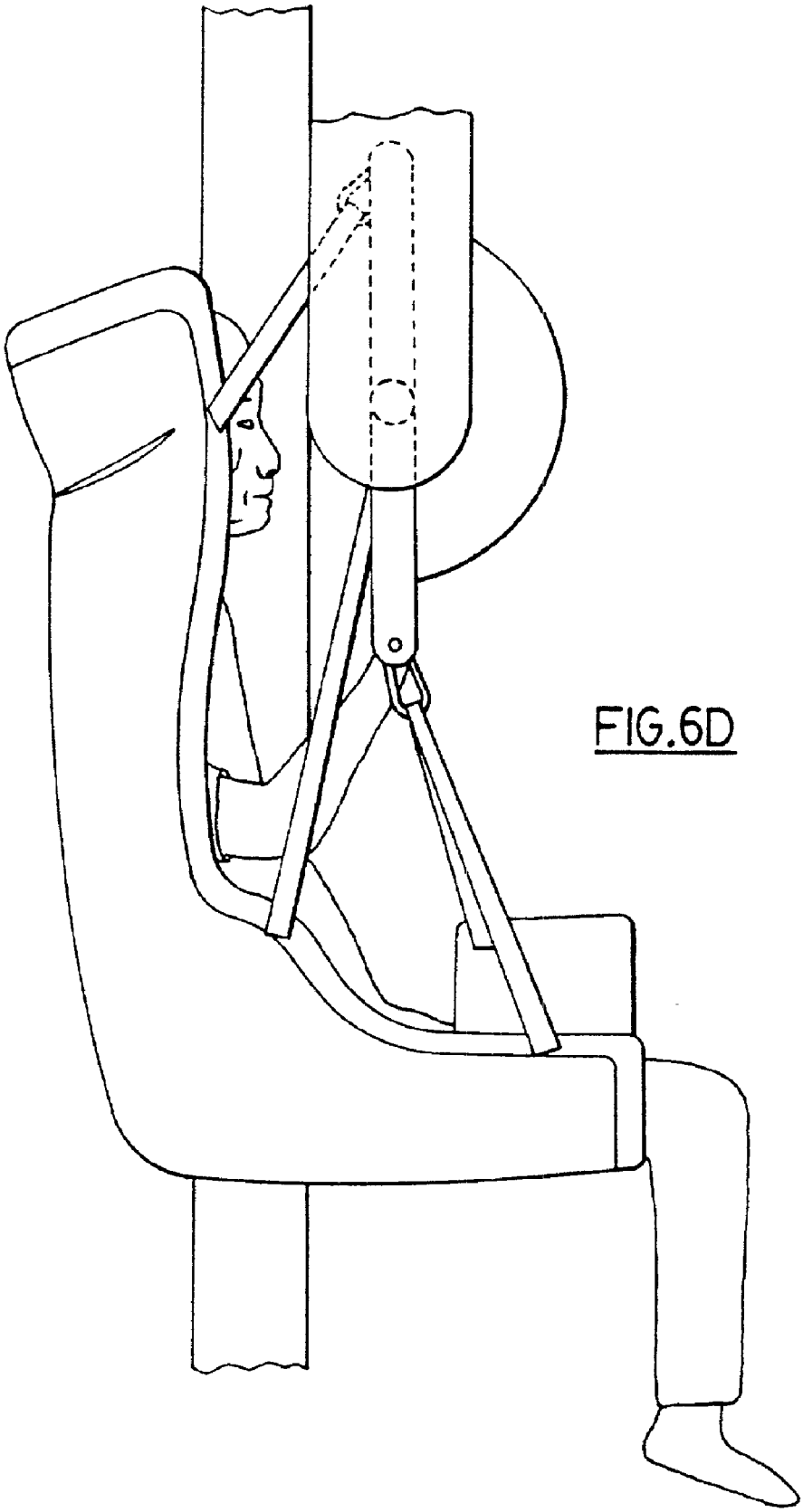

Thus, the cross member 22, when gripped by the patient, can add to the patient's stability if the patient is in fact above to grip the cross member when being transferred in the final stages of the upright orientation, that is as shown in FIG. 6D, thus reducing the fear of tumbling forward. In this case, the cross member acts as a barrier for the patient when in the upright orientation.

The operator can, if desired, shift the seat closer toward the patient so that the operator can place a hand on the patient either to guide the patent while being swivelled or simply to give a sense of security to the patent during travel. When in the reversed position of FIG. 5, the operator can move the seat sufficiently close to embrace the patient if desired with the operators knees and hand while manipulating the controls to cause the truck to travel to another location. The patient, in this instance, is not merely dangling from the lifting device but rather is being guided both by the harness and by the physical contact with the operator, if necessary. The operator can then manipulate the controls to transfer the patient to another position, perhaps to another chair which would involve returning the patient to an orientation according to FIG. 4 or to an inclined or lying position on a bed or stretcher as shown by FIG. 6.

This transfer from the upright orientation to the inclined orientation, although involving a rather complex movement of the body, involves the relatively simple task of bringing the beam members from their position as shown in FIG. 6C to that shown in FIG. 6 and in so doing cause the body to be returned in a smooth transition back to an inclined orientation.

During the transfer, the beams move to change the relative positions of the anchor locations and the contact locations, the former of which remain fixed in length from one another, but change in elevation relative to one another. In effect, each of the outer anchor locations draw a circular arc in space relative to the central anchor location. The central anchor location may also draw an arc relative to the first rotation axis A1 depending on the spacing therebetween. The contact locations, in contrast to the anchor locations in this case, are not fixed in length relative to one another and they are defined by the orientation of the harness They may in fact move toward or away from one another and this combination of the fixed anchor locations and the movable contact locations does present a smooth transition for the patient from the inclined and upright orientations.

A particular feature of the device is that the harness can be used to bring the patient to a position equivalent to that which the patient essentially would adopt if sitting in a chair. This can be seen in FIG. 6D where the beam members the patient's back is essentially upright and not slouched as in the position shown in FIG. 6C. The position in FIG. 6D is useful because the operator can position the patient in a chair with the patient's pelvic region comfortably pressed against the back of the chair.

If desired, a supplemental patient seat 50 may be provided as shown if FIG. 5 for supporting the patient when the patient during transfer. In this case, the supplemental patient seat is positioned on the lift portion.

Figure 10:
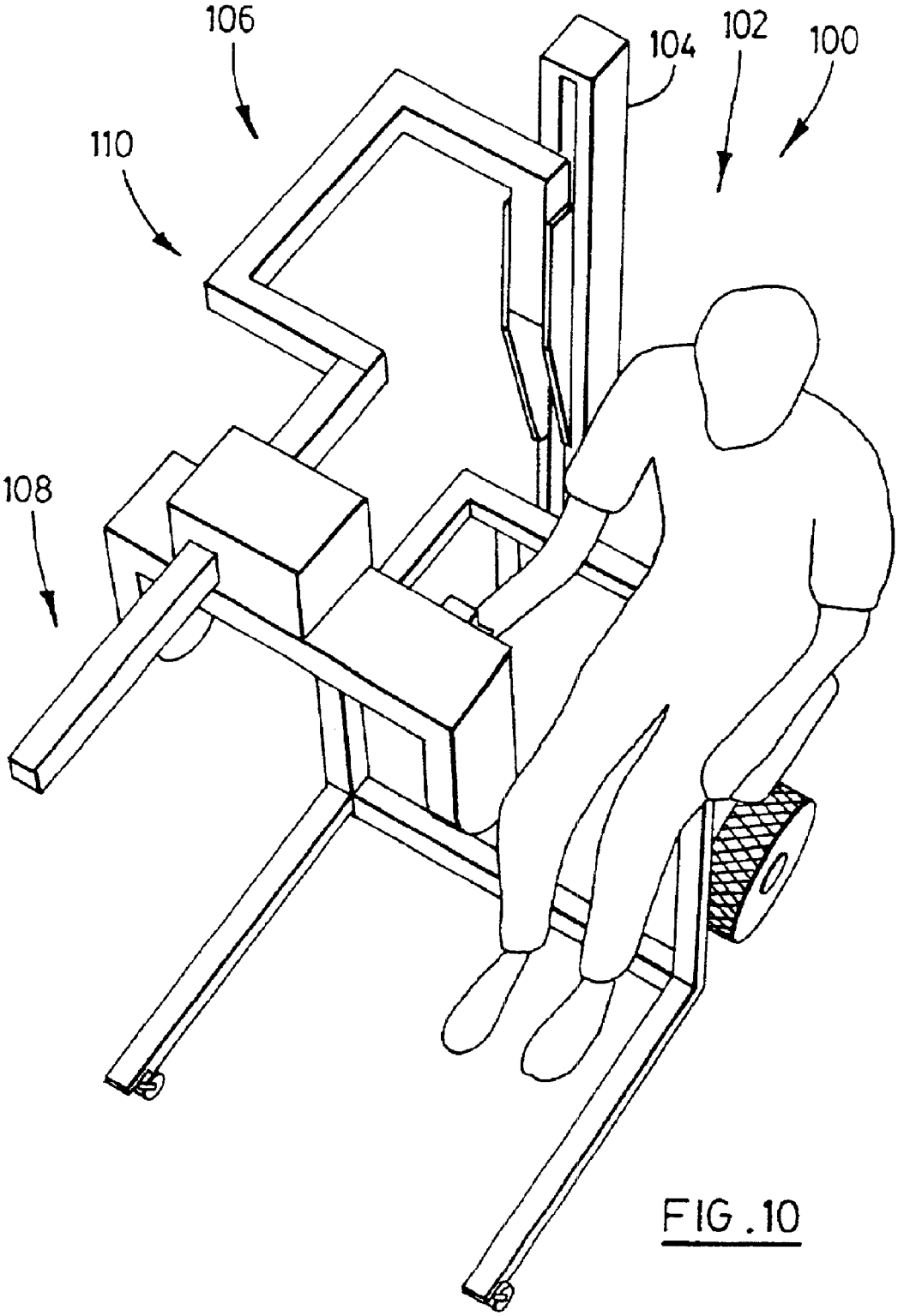
FIG. 10 is a fragmentary perspective view of another patient transfer device.

Referring to FIG. 10, another device is shown at 100. In this case, lift portion 102 includes a truck, not shown, having a height adjustable post 104 which in this case extends upwardly from behind the operator rather than in front of the operator as in the device 10 hereinabove. The track portion 106 is oriented so as to extend the carriage portion in front of the truck and in a manner to minimize the operator's obstruction. To achieve this, the track portion includes a frame, or jib, with a remote region 108 to engage the carriage portion and an intermediate region 110 positioned between the remote region and the lift portion, the intermediate region being offset from the remote region and away from the operator location.

This should allow the operator to interact with greater freedom with the patient. For example, the operator can bring the patient closer without potential injury through collisions with the post 104. This is a particular benefit since the ability for the operator and the patient to interact closely provides for greater safety and comfort of the patent and avoids the operator having to step off the device to reach for certain tasks and the need to recruit an assistant to help. For example, it may be possible to bring the patient to a horizontal orientation and in close proximity with the operator, so that the operator can lift the patient's lower legs to position them on an operating table or bed. This should also be advantageous with the adjustable seat of the earlier embodiment so that the operator and the patient, can interact more closely without the need for the operator to step off the device.

Figure 9:
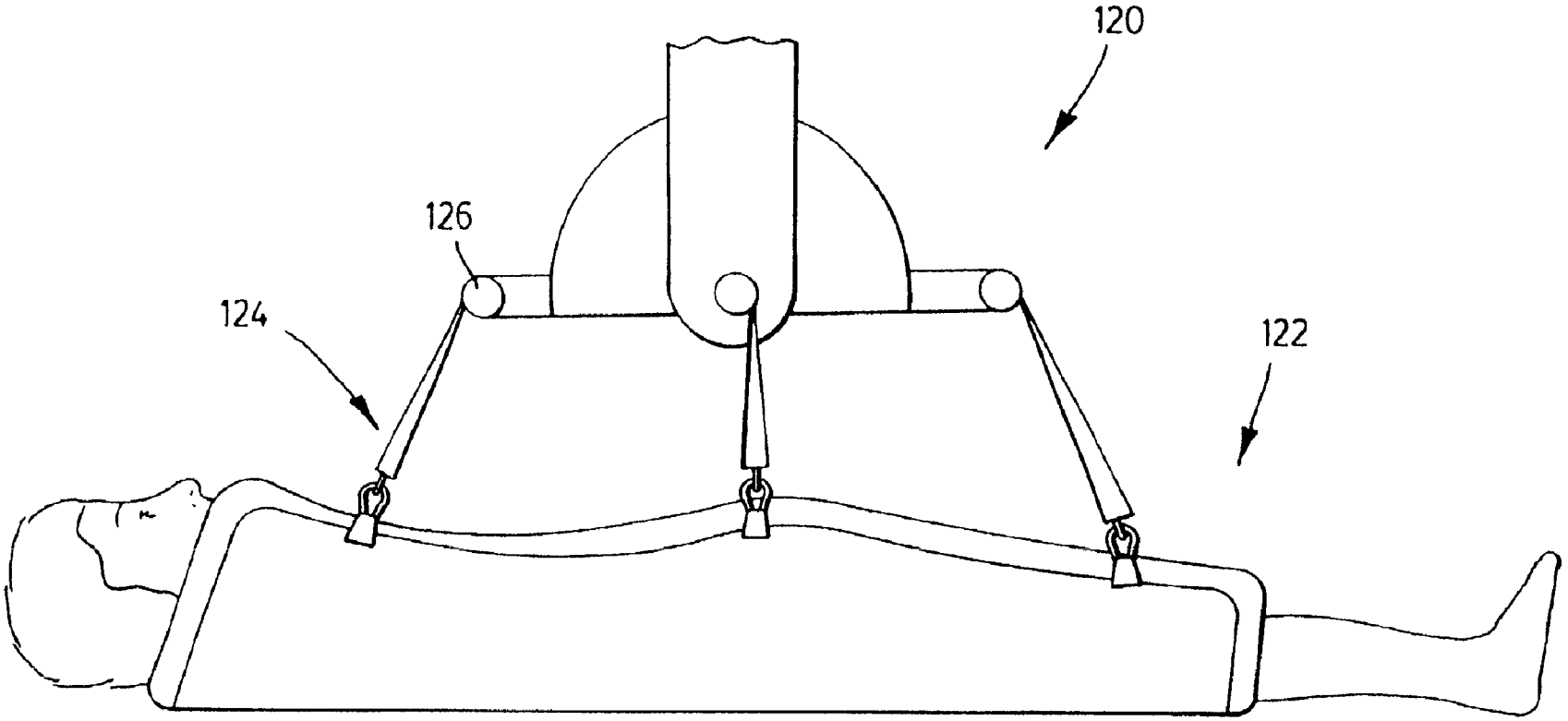
FIG. 9 is a side view of the another patient transfer device in an operative position.

Referring to FIG. 9, there is provided still another patient transfer device 120. In this case, the harness 122 has tension members 124 where at least some of the tension members are length adjustable and dispensing mechanisms 126 are provided for dispensing the tension members to a predetermined length, in a manner similar to a tape measure. The dispensing mechanisms 126 can, if desired, be arranged to dispense the tension members to a constant length or alternatively be provided with a locking mechanism to lock the length of the tension members as desired. In addition, the dispensing mechanisms may also be motorized if desired to control the length of the tension members and thus to give another degree of postural control while moving between the inclined and upright orientations.

Figure 11B:
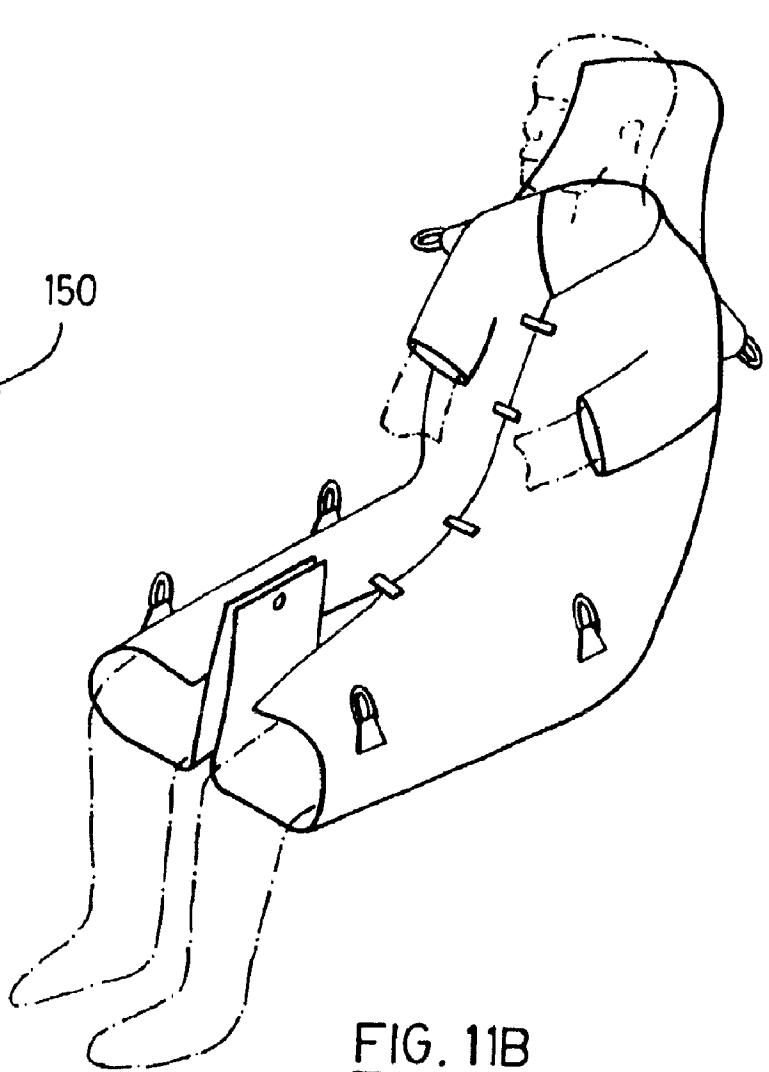
FIGS. 11A and 11B are perspective views of portions of other alternative patient transfer devices.
Figure 11A:
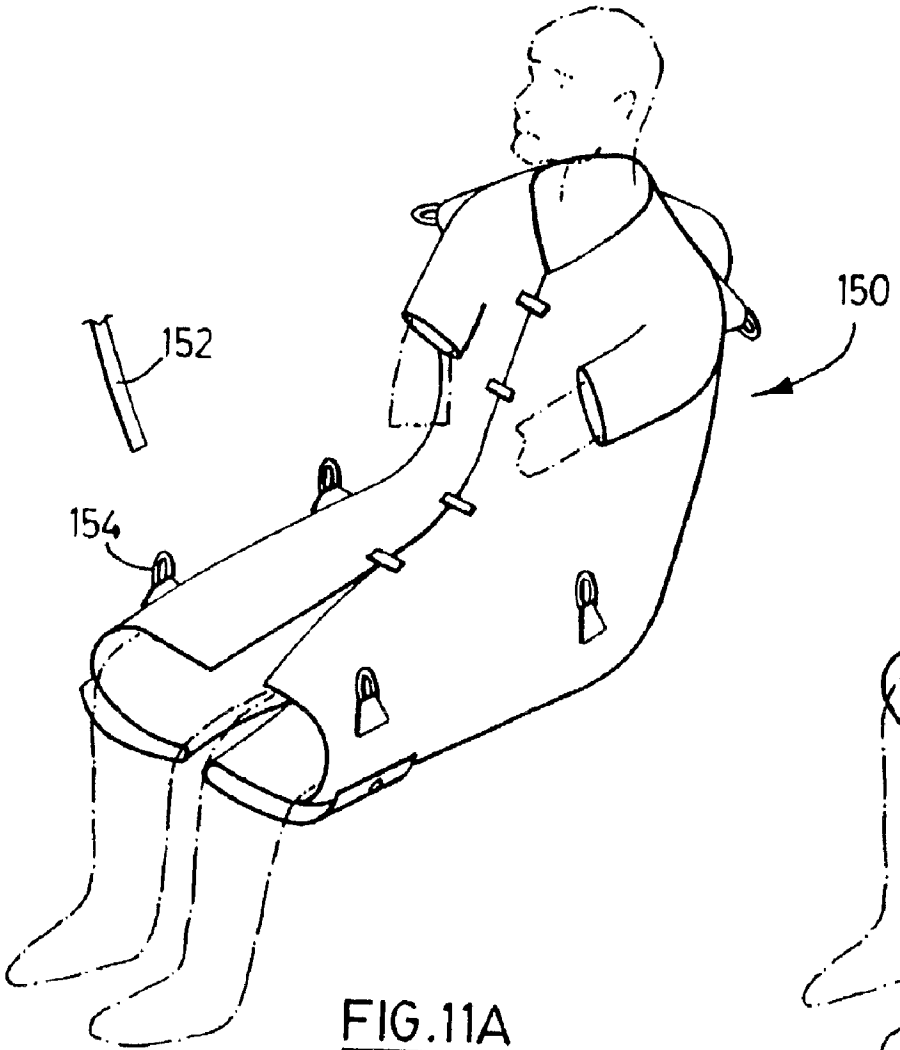

If desired, the harness may be incorporated into an article of clothing to be worn by the patient as shown at 150 in FIGS. 11A and 11B. In this case, the tension members may include straps 152 with one end fastened to the article of clothing, that is to one of a number of contact locations, in the form of rings 154, as described hereinabove. Thus the article 150 can function as a wearable sling which should reduce the effort required to put patients on and off slings during the day and should reduce any stigma or awkwardness felt by the patient as a result of being left on a sling as mentioned hereinabove, should this become a problem for the patient. This wearable sling can be made of materials that can be coloured appropriately to be attractive and can be equipped with loops or rings as shown herein or with the tension members incorporated therewith. In this case, the wearable sling 150 or the harness as shown above can be used along with other versions thereof with the device 10.

Thus, the device 10 provides a method of transferring a patient from an inclined orientation to an upright orientation, comprising the steps of:

providing a support beneath the patient, providing on the support a pair of central contact locations near the a central body location of the patient and on opposite sides thereof;

providing on the support a pair of outer contact locations on opposite sides of the pair of central contact locations and spaced therefrom, wherein the support is capable of bearing the weight of the patient in the inclined orientation at the central and outer contact locations; and lifting the support at the central and outer contact locations in such a manner to raise the patient to the upright orientation.

In this case, a first of the pairs of outer contact locations are positioned near a shoulder region of the patient, the step of lifting further comprises the step of raising the first pair of outer contact locations a distance greater than the pair of central contact locations in the upright orientation. A second of the pairs of outer contact locations are positioned near a leg of the patient, the step of lifting further comprises the step of raising the second pair of outer contact locations to position lower than the central contact locations in the upright orientation.

The step of lifting may include the steps of providing a manipulator arrangement with a pair of central anchor locations and a pair of outer anchor locations on opposite sides of the pair of central anchor locations and spaced therefrom; joining each of anchor locations with a corresponding contact location; and actuating the manipulating arrangement.

The actuating step includes the steps of arranging the anchor locations in position relative to a plane and rotating the plane about a first axis.

The step of arranging the anchor locations includes the step of fixing the anchor locations relative to one another. The step of arranging the anchor locations includes the steps of providing a pair of beam members, and spacing the beam members so as to be aligned along respective sides of the patient.

The method herein may also include the steps of joining one end of each of the beams with a cross member; and providing a pair of handle formations on the cross member so that the patient can grip the cross member for support.

Thus, the devices and techniques herein provide a safe and economical technique for transferring patients between inclined and upright orientations. There are of course numerous alternatives that can be employed while not departing from scope of the present invention. For example, provision may be made to adjust the position of the anchor locations relative to one another by arranging the beam members to be length adjustable. The beam members need not necessarily rotate about a rotation axis that extends through the beam members themselves but rather an axis that is laterally spaced therefrom. The harness used with the device need not necessarily be a sling as shown herein but may provide the multiple contact locations in other forms. The device may also work in some cases with just one beam located above the patient, provided the harness provides sufficient space to allow the patient to move between the inclined and upright orientations in comfort. The beam members need not necessary be planar but may be articulated or be bent along their length as desired. The beams may be narrower or wider than the length of the patient and may, if desired, be made adjustable to accommodate different patients. The device may also provide some benefits when used with the beams supporting the harness by two anchor locations, rather than three as above mentioned.

What is claimed is:

1. A patient transfer device comprising:

lifting means positionable adjacent a patient and movable between a first position and a second position, and support means for supporting said patient, said support means being attachable to said lifting means along a number of anchor locations thereon, said anchor locations including a pair of central anchor locations, a first pair of outer anchor locations on one side of said pair of central anchor locations and a second pair of outer anchor locations on an opposite side of said central pair of anchor locations; said support means including a pair of central contact locations near a central location on the body of said patient, a first pair of outer contact locations on one side of said pair of central contact locations and a second pair of outer contact locations on an opposite side of said central pair of contact locations;

said support means being operable with said lifting means for joining each of said anchor locations to a corresponding one of said contact locations, so as to transfer said patient between an inclined position and an upright orientation when said lifting means moves between said first and second positions, wherein said anchor locations are fixed in position relative to one of said beam members and said central contact locations are movable relative to one another as said patient moves between inclined and upright orientations, wherein said lifting means includes a pair of beam members, wherein said support means includes a plurality of tension members for joining each of said contact locations with a corresponding one of said anchor locations, and a third pair of outer contact locations near said first pair of contact locations, said plurality of tension members further including a pair of tension members, each for joining each of said third outer contact locations with a corresponding one of said outer anchor locations.

2. A device as defined in claim 1 wherein each of said outer anchor locations draws an arc relative to a corresponding one of said central anchor locations when said lifting means moves between said first and second positions.

3. A device as defined in claim 2 wherein said anchor locations lie in a common plane rotatable relative to a first rotation axis.

4. A device as defined in claim 3 wherein said rotation axis is positioned near said pair of central anchor locations and said outer anchor locations draw an arc in a common clockwise sense.

5. A device as defined in claim 1 wherein said support means further comprises a harness, wherein each of said central contact locations are defined thereon.

6. A device as defined in claim 5, wherein said harness includes a first end to be positioned adjacent the legs of said patient and a second end to be positioned near the head of said patient, each of said first outer contact locations being positioned adjacent an outer side of a corresponding leg of said patient, each of said third outer contact locations being positioned adjacent an inner side of a corresponding leg of said patient.

7. A device as defined in claim 6 wherein said harness includes a sheet member having a pair of longitudinal peripheral regions to lie adjacent each side of said patient, each of said central contact locations and each of first and second pairs of outer contact locations being defined on a corresponding one of said peripheral regions.

8. A device as defined in claim 7 wherein said sheet has a pair of inner peripheral edge regions in said first end defining a centrally located longitudinally oriented gap, each of said third outer contact locations being positioned adjacent said gap.

9. A device as defined in claim 8 further comprising a pair of flap portions, each of said third outer contact locations being formed on a corresponding flap portion.

10. A device as defined in claim 5 wherein said harness is incorporated into an article of clothing to be worn by said patient.

11. A device as defined in claim 10 wherein said tension members further comprise straps with one end fastened to said article of clothing.

12. A device as defined in claim 1 wherein said lifting means further comprises a track portion, a carriage portion movable along said track portion, said carriage portion including mounting means for mounting said beam members thereto.

13. A device as defined in claim 12 wherein said mounting means includes a yoke portion extending between said carriage member and said beam members.

14. A device as defined in claim 13 wherein said yoke portion is mounted for movement relative to said carriage about a yoke swivel axis.

15. A device as defined in claim 14 wherein said beam members are mounted for synchronized movement relative to said yoke portion about a beam rotation axis.

16. A device as defined in claim 15 wherein said beam rotation axis is coextensive with said first rotation axis.

17. A device as defined in claim 16 wherein said beam members have a first end and a second end, further comprising a cross member joining said first ends.

18. A device as defined in claim 17 further comprising a lift portion, said track portion being mounted for movement relative thereto along a lift axis.

19. A device as defined in claim 18 wherein said lift portion includes a truck and a post extending upwardly therefrom and means for lifting said post relative to said truck.

20. A device as defined in claim 19 wherein said truck further comprises a set of controls and an operator location on which a truck operator is situated to operate said truck.

21. A device as defined in claim 20 wherein said track portion is oriented so as to extend said carriage portion in front of said truck and in a manner not to obstruct said operator location.

22. A device as defined in claim 21 wherein said track portion includes a frame with a remote region to engage said carriage portion and an intermediate region positioned between said remote region and said lift portion, said intermediate region being offset from said remote region and away from said operator location.

23. A device as defined in claim 22 further comprising beam motor means for displacing said beam members relative to said yoke portion, and yoke motor means for displacing said yoke portion relative to said carriage portion.

24. A device as defined in claim 22 wherein said operator location includes a seat, said seat being movable between a first portion remote from said patient and a second portion adjacent said patient.

25. A device as defined in claim 18 further comprising a supplemental patient seat for supporting said patient when said patient during transfer.

26. A device as defined in claim 25 wherein said supplemental patient seat is positioned on said lift portion.

27. A device as defined in claim 1 wherein at least some of said tension members are length adjustable.

28. A device as defined in claim 27 further comprising dispensing means for dispensing said tension members to a predetermined length.

29. A device for transferring a patient, said patient having a upper region, a mid region and a lower region, said device comprising a lifting means and a sling means, said sling means being dimensioned to extend beneath and along said upper, mid and lower regions, and transfer means arranged to join said lifting means with said sling means at a number of locations along said sling means, said locations being selected to cause said upper and lower regions to be rotated relative to said mid region as said lifting means is moved between a first position and a second position, said lifting means including a pair of beam members which are aligned with said patient in one of said positions, said transfer means including a plurality of length extensible tension members along said beam members, said tension members including a pair of central tension members and an outer pair of tension members on each side thereof, wherein each of said central tension members engages said sling means adjacent said mid region and each of said outer tension members engages said sling means adjacent one of said lower and upper regions respectively, said lower region including a patient's legs and each beam supporting a pair of outer tension members on one side of said central tension members, each pair of outer tension members being arranged to engage said sling means on opposite sides of a corresponding one of said legs, and a cross member joining said beams at one end, said cross member being arranged to function as a hand grip for said patient.

30. A device for transferring a patient, said patient having a upper region, a mid region and a lower region, said device comprising a lifting means and a sling means, said sling means being dimensioned to extend beneath and along said upper, mid and lower regions, and transfer means arranged to join said lifting means with said sling means at a number of locations along said sling means, said locations being selected to cause said upper and lower regions to be rotated relative to said mid region as said lifting means is moved between a first position and a second position, said lifting means including a pair of beam members which are aligned with said patient in one of said positions, said transfer means including a plurality of tension members alone said beam members said tension members including a pair of central tension members and an outer pair of tension members on each side thereof, wherein each of said central tension members engages said sling means adjacent said mid region and each of said outer tension members engages said sling means adjacent one of said lower and upper regions respectively, said lower region including a patient's legs and each beam supporting a pair of outer tension members on one side of said central tension members, each pair of outer tension members being arranged to engage said sling means on opposite sides of a corresponding one of said legs, and dispensing means for dispensing at least some of said tension members to a predetermined length.

31. A patient transfer device, comprising a manipulator arrangement rotatable about a first axis between a plurality of operable positions, support means supporting a patient beneath said manipulator arrangement, said manipulator arrangement including a pair of central anchor locations to support said patient on opposite sides and near a central body location thereof and a pair of outer anchor locations on either side of said central anchor locations to support said patient on opposite sides of and at spaced locations from said central body location, said central and outer anchor locations being arranged to move said patient from an inclined orientation to an upright orientation when said manipulator moves between at least two of said operable positions, said manipulator arrangement including a pair of beam members arranged to extend along said patient in one operative position and rotatable about said first axis, each of said beam members having central regions providing said central anchor locations and opposed end regions, each providing a corresponding one of said outer anchor locations, said beams forming a plane and said rotation axis extending through said plane, further comprising a cross member extending between said beams at corresponding adjacent end regions thereof, wherein said cross member is rigidly coupled to said beams, said beams in said second operative position extending in front of said patient, said cross member being arranged to extend sufficiently close to said patient for gripping said cross member for support, wherein said cross member is provided with a pair of handle formations thereon, wherein said manipulator arrangement includes a pair of frame members, each of which is joined to a corresponding beam member.

* * * * *